United States Patent [19]

McComas et al.

[11] 4,275,124

[45] Jun. 23, 1981

[54] CARBON BEARING MCRALY COATING

[75] Inventors: Charles C. McComas, Stuart; James W. Morris, Jupiter; Larry S. Sokol, West Palm Beach, all of Fla.

[73] Assignee: United Technologies Corporation, Hartford, Conn.

[21] Appl. No.: 85,131

[22] Filed: Oct. 15, 1979

Related U.S. Application Data

[63] Continuation-in-part of Ser. No. 949,926, Oct. 10, 1978, abandoned, which is a continuation-in-part of Ser. No. 842,838, Oct. 17, 1977, abandoned.

[51] Int. Cl.[3] ..... B05D 1/10

[52] U.S. Cl. ..... 428/564; 75/240; 427/34; 427/423; 428/678; 428/679; 428/937

[58] Field of Search ..... 75/124, 126 R, 171, 75/240; 428/564, 578, 667, 668, 679, 680, 682, 678, 937; 427/34, 423

[56] References Cited

U.S. PATENT DOCUMENTS

| | | | |
|---|---|---|---|
| 3,023,130 | 2/1962 | Wasserman et al. | 428/564 |
| 3,150,938 | 9/1964 | Pelton et al. | 428/564 |
| 3,230,097 | 1/1966 | Fischer | 428/564 |
| 3,542,530 | 11/1970 | Talboom et al. | 428/667 |
| 3,556,747 | 1/1971 | Hyde et al. | 428/937 |
| 3,655,425 | 4/1972 | Longo | 428/937 |
| 3,676,085 | 7/1972 | Evans et al. | 75/171 |
| 3,754,898 | 8/1973 | McGurty | 75/122 |
| 3,754,902 | 8/1973 | Boone et al. | 75/171 |
| 3,754,903 | 8/1973 | Goward et al. | 428/667 |
| 3,837,817 | 9/1974 | Nakamura | 428/564 |
| 3,873,347 | 3/1975 | Walker et al. | 427/405 |
| 3,928,026 | 12/1975 | Hecht et al. | 75/171 |
| 3,955,935 | 5/1976 | Shockley et al. | 428/553 |
| 3,992,161 | 11/1976 | Cairns et al. | 75/126 R |
| 4,054,723 | 10/1977 | Higginbotham et al. | 75/171 |
| 4,117,179 | 9/1978 | Jackson et al. | 427/34 |
| 4,124,737 | 11/1978 | Wolfla | 75/134 F |
| 4,146,080 | 3/1979 | Baum | 75/240 |
| 4,163,071 | 7/1979 | Weatherly et al. | 427/34 |

*Primary Examiner*—John H. Newsome
*Attorney, Agent, or Firm*—C. G. Nessler

[57] ABSTRACT

A protectively coated superalloy has improved oxidation, corrosion, and wear resistance at elevated temperatures. The protective coating is a MCrAlY type alloy having a carbon content of 0.6 to 11 percent and is characterized in a preferred embodiment by having a carbon bearing matrix containing metal carbides of 1–2 microns mean size and chromium carbides of less than 12 microns. The coating is preferredly produced by plasma spraying and heat treatment.

5 Claims, 4 Drawing Figures

CARBON BEARING MCRALY COATING

BACKGROUND OF THE INVENTION

This is a continuation-in-part of U.S. application Ser. No. 949,926 filed Oct. 10, 1978 which was a continuation-of-part of U.S. application Ser. No. 842,838, filed Oct. 17, 1977, both now abandoned. It is also related to Ser. No. 085,132 filed the same day as this application.

The present invention relates to protective coatings and coated components and, more particularly, to coatings having high temperature oxidation, corrosion, and wear resistance for application to superalloy parts.

In modern gas turbine engines, certain engine components, such as superalloy turbine blades, must be provided with both oxidation and wear resistance at very high temperatures. These properties are especially important with respect to the Z-notch (a "Z" shaped area, when planar viewed, serving to interlock adjacent blade shrouds) on a turbine blade tip shroud which rubs against the Z-notches of adjacent turbine blades and is subject to severe wear and oxidation.

In the past, the Z-notch has been protected by various materials including puddle welded nickel or cobalt alloy hardface coatings, typical of which is a cobalt base alloy of nominal composition, by weight, 28% Cr, 5% Ni, 19.5% W, 1% V, balance cobalt. Although capable of providing protection to the Z-notch area of the blade tip shroud during engine operation, such hardface coatings are expensive to apply by the puddle weld process, can cause base metal cracking, and, in some cases, service life has been less than satisfactory. Other more economical techniques for applying the alloy hardface coatings, such as conventional plasma spraying, are unsatisfactory due to inadequate adhesion of the coating during service. Another type of material which has been used as a heat, wear, and corrosion resistant coating is that in which hard particles are imbedded in a softer matrix of which, tungsten carbide in a cobalt matrix is a familiar example for lower temperatures up to 1000° F. According to Wasserman et al., U.S. Pat. No. 3,023,130, refractory carbide particles are included in heat resisting iron base welding alloys. Chromium carbide particles have often been preferred, usually in amounts up to 90 percent by weight. For example, in Pelton et al., U.S. Pat. No. 3,150,938, 325 mesh and finer sieve size particles have been included in a nickel chromium (80%-20%) alloy; in Hyde et al., U.S. Pat. No. 3,556,747, particles have been included in a molybdenum matrix with minor amounts of nickel chromium, and; in Fischer, U.S. Pat. No. 3,230,097, they have been included in a chromium and lower melting point nickel brazing alloy. The aforementioned coatings are applied by various methods, including welding, but flame or plasma spraying is most prevalent.

There are two characteristics of the alloys and coatings which are notable. First the matrices do not have sufficient oxidation-corrosion resistance for gas turbine Z-notch applications. Second, chromium carbide particles, per se, are included in the coating in its use condition. That is, the exact chromium carbide particles in the applied mixture are the particles intended to be in the adhered coating alloy. The function of the matrix alloy is simply to be the binder. Therefore, the chromium carbide particle and metal matrix coatings heretofore known are susceptible to failure due to undercutting and pullout of the particles due to wear, erosion, corrosion, or oxidation of the matrix. Consequently, the performance of composite coatings containing particles, is limited by the matrix. Therefore there is need for a far improved coating which tends to be more homogeneous or monolithic and have better performance.

It is well known that the family of protective coatings generally referred to as MCrAlY coatings, where M is selected from nickel, cobalt and iron and their mixtures, can provide superior oxidation-corrosion resistance in the high temperature engine environment compared to other types of coatings and the matrix materials of the aforementioned carbide containing coatings. For example, see U.S. patents to Evans et al., U.S. Pat. Nos. 3,676,085; Goward et al., 3,754,903; Hecht et al., 3,928,026 and Talboom, Jr. et al., 3,542,530, all of common assignee herewith. However, in the past, these MCrAlY coating alloys have been applied to the airfoil and root portions of the superalloy blade where there is no rubbing or like conditions promoting wear nearly as severe as those to which the Z-notch of the blade tip shroud is subjected.

Heretofore, MCrAlY coatings have not purposefully contained substantial amounts of carbon, as it was not considered beneficial. In fact, migration of the carbon from certain superalloy base metals has been observed to cause the undesired formation of chromium carbides at the coating-base metal interface and suppression was sought, as for example, is described in Shockley et al., U.S. Pat. No. 3,955,935. A relatively esoteric case to the contrary occurs when some specialty alloys contain a rather high carbon content, e.g. Ni-Ta-C eutectic alloys. Here, as described in Jackson et al. U.S. Pat. No. 4,117,179, a MCrAlY coating containing some (~0.1 wt. %) carbon is used to avoid debilitating migration of carbon from the alloy. But the carbon content in the coating is minimized to avoid the formation of carbides, and there is no suggestion nor likelihood of improved wear resistance.

There is another contemporaneous U.S. patent which has relation to the instant invention. Wolfa et al., U.S. Pat. No. 4,124,137 discloses a tantalum carbide containing Co-Cr alloy coating for resisting wear at high temperature. The coating in its broadest form consists essentially by weight percent of 17-35 Cr, 5-20 Ta, 0.5-3.5 C, balance Co. Other embodiments contain rare earth metals, Al, Si, and various metal oxides. Of course, as is well known and mentioned in Wolfa et al., Ta is a solid solution strengthener in high temperature alloys. While preferred for oxidation-corrosion resistance over W and Mo, as a refractory metal Ta at best does not improve the oxidation-corrosion resistance of a CoCrAlY alloy, and most likely degrades it, if only by replacing other elements in the system.

Of course, as has been well-documented in the literature, aircraft gas turbines operate at the extreme conditions of material durability. A material optimized for one condition, e.g. oxidation at 1100° C., may fare poorly at another condition, e.g. hot corrosion at 900° C., and vice versa. There are often necessary compromises as a result. The addition of the requirement for wear resistance adds a further variable to be addressed. Thus, there is still a need and room for improvement in coating alloys to achieve the highest performance in a gas turbine.

SUMMARY OF THE INVENTION

An object of the invention is to provide a wear, oxidation, and corrosion resisting coating alloy and a coated superalloy article, useful at temperatures up to 1000° C. or higher.

According to the invention, the improved coating is comprised of chromium, aluminum, yttrium, and carbon with the balance being selected from the group consisting of nickel, cobalt, iron, or mixtures thereof. The invention results in a coating consisting essentially of a carbon rich MCrAlY matrix containing fine metal carbides of the order of 1–2 microns size and chromium carbides of the order of 12 microns. An embodiment entails a coating composition consisting essentially of, by weight, 18–80% chromium, 1.2–29% aluminum, up to 4.8% yttrium, 0.6–11% carbon, balance selected from the group consisting of nickel, cobalt and iron or mixtures thereof. Advantageously, the coating composition consists essentially of, by weight, 23–68% chromium, 4–22% aluminum, up to 4.4% yttrium, 1.5–7.8% carbon, balance selected from the group consisting of nickel, cobalt and iron or mixtures thereof. In one preferred embodiment, the coating composition consists essentially of, by weight, 36% chromium, 10% aluminum, 2.6% carbon, 0.52% yttrium, and balance cobalt. The improved coating consists of complex compounds of the deposited elements compared to simply chromium carbide particles entrapped in a metal matrix as known in the prior art. The coating is believed to include within its structure complex MCrAlY compounds having substantial carbon content together with nonstoichiometric transition metal carbides, as well as $Cr_3C_2$.

The peculiar morphology of the coating, the combination of fine and coarse carbides, provides a particularly durable and hard matrix with well-bonded larger wear resisting chromium carbide complexes.

The aforementioned compositions may be applied by different methods, but a preferred method is to plasma spray a mixture of $Cr_2C_3$ and MCrAlY of suitable particle sizing and proportion onto a superalloy substrate. After plasma spraying the coating is heat treated to prepare the coating for use, preferably.

The coating of the invention finds special use as a protective coating on turbine blade tip shrouds made of nickel, cobalt, and iron base superalloys to provide significantly increased service life in the gas turbine engine environment.

These and other advantages, objects and uses of the invention will appear more fully from the following Figures and detailed description of the preferred embodiment.

DESCRIPTION OF THE PREFERRED EMBODIMENT

Figure 1:
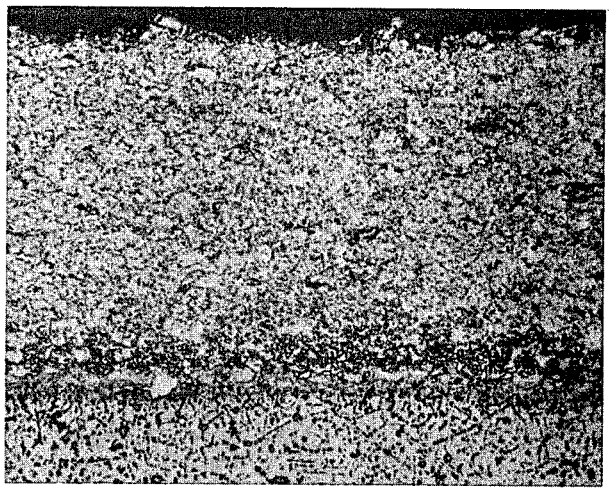
FIGS. 1 and 2 are conventional light microphotographs of cross sections through a heat treated coating of the present invention at 250× and 500×, respectively, after a 5% chromic acid electrolytic etch.
Figure 2:
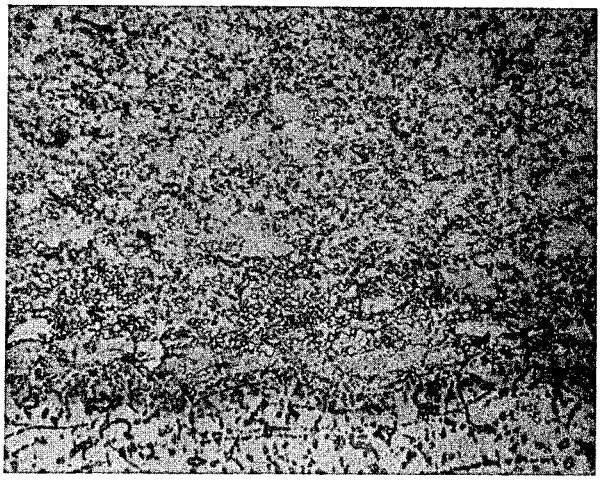

The superalloys are generally those alloys characterized as nickel, cobalt or iron base alloys which display high strengths at high temperatures. There are a number of superalloys which are used in gas turbine engines. Of these, the greatest physical demands are usually placed on those alloys employed in blades and vanes in such engines since the blades and vanes face the highest stress at the highest temperature. With respect to blades, the most severe service in terms of oxidation, corrosion, and wear is experienced by the Z-notch area on the blade tip shrouds which areas rub against each other during engine operation. Typical nickel base alloys used for blades are IN 100, INCONEL 792, INCO 718, and MARM 200; typical cobalt base alloys are WI-52 and MARM 509.

FIGS. 1, 2, 3 and 4 show a 0.023 cm thick coating of the present invention in which the composition comprises, by weight, 36% Cr, 10% Al, 2.6% C and 0.52% Y, and balance cobalt, which was applied to a superalloy substrate of Inconel 718. As can be seen from the Figures, there is a multiphase structure which on microanalysis appears to include complex carbide particles more or less randomly dispersed throught the matrix which is found by probe to be carbon bearing. The larger complex carbides are very fine in size, having an average diameter of about 10 microns and are generally less than 15–20 microns.

To insure high coating density and the desired complex structure, the coating is applied to the substrate by the advanced plasma spray process and apparatus described in copending patent application Ser. No. 974,666, filed Nov. 3, 1978. In the advanced process, the powders needed to form the coating are injected into a cooled plasma gas and then sprayed onto the substrate. The advanced technique was used to form the coating shown in the Figures. A physical mixture of two minus 44 micron particle size powders, one a MCrAlY type alloy powder comprised by weight of 63% cobalt, 23% chromium, 13% aluminum, and 0.65% yttrium and the other a chromium carbide ($Cr_3C_2$) powder comprised by weight of 87% chromium and 13% carbon, was injected into the plasma gas stream. About 50% of the mixture by weight was CoCrAlY powder. After inert plasma spraying by this technique, the coated article with the structure shown in FIG. 3, was heat treated at 1080° C. (1975° F.) for four hours to form a diffusion bond between the coating and the substrate, and produced a somewhat different structure, shown in FIGS. 1, 2 and 4. Other temperature and time combinations will be usable to achieve the same result as described herein, as the skilled person will readily ascertain.

The coating described above and others of similar nature were examined by various metallurgical techniques including, wet chemistry, light microscopy, x-ray diffraction, and scanning electron microscopy to identify constituents and morphology. The chemical composition for the as-deposited coating shown in FIG. 3 was determined using electron microphobe x-ray energy analysis, specifically, using an Etec Auto Probe with a Kevex 5100 x-ray energy analyzer tracing a number of different locations for Co, Cr, and Al and calculating Y and C. It was found that the chemical composition by weight was nominally 51% cobalt, 36% chromium, 10% aluminum, 2.6% yttrium. This indicated that the constitutent powder passes through the plasma spraying device deposited a composition which would result from the ratio of 80% MCrAlY and 20% $Cr_3C_2$. Of course small percentage variations are to be normally expected in the composition of MCrAlY coating powder compositions as well as variances in electron microprobe compositional analysis. Consequently, it will be understood that the conclusions herein are subject to these limitations of precision. It is well-known by those skilled in the art of coating that all the powder passing through a plasma spraying device does not deposit on the substrate, and that different powders have different deposition rates, or deposit efficiencies, for the same spraying condition. Consequently, we take care herein to distinguish between the material which is sprayed and that which is deposited. Such a distinction is not always present in the prior art.

Figure 3:
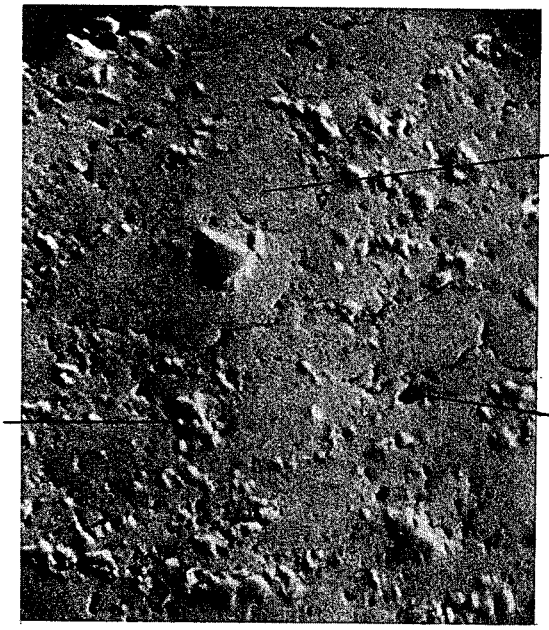
FIG. 3 is a scanning electron microscope photomicrograph of a cross section through a coating of the present invention at 1000×.

Many compounds were present which were not characterizable with reference to standard x-ray diffraction patterns or prior examinations of MCrAlY coatings. Therefore, it is speculated that the coating is comprised of very fine (1–2 micron) complex metal carbides, nonstoichiometric carbides and metastable compounds. Phases identifiable as $Cr_3C_2$ carbides were present in the as-deposited coating such as shown in FIG. 3, but in sizes (seldom exceeding 12 microns) considerably smaller than the 15 micron average size carbide particles which had been included in the mixture passed through the spraying device. In addition, the microprobe analysis showed that only 5 to 10 percent of the as-deposited coating by weight was the crystallographic compound $Cr_3C_2$. The remainder of the chromium and carbon must therefore be alloyed with or precipitated within the fine compounds of the CoCrAlY matrix. This is an unexpected result based on the prior art which does not appear to teach coating systems in which such interactions occur.

It is likely that the regions identified as $Cr_3C_2$ may be partially diluted with metals of the matrix, at least at their periphery, and therefore in reference to a particle, the term chromium carbide as used herein should be taken to include these more complex and diluted compounds of $Cr_3C_2$.

Figure 4:
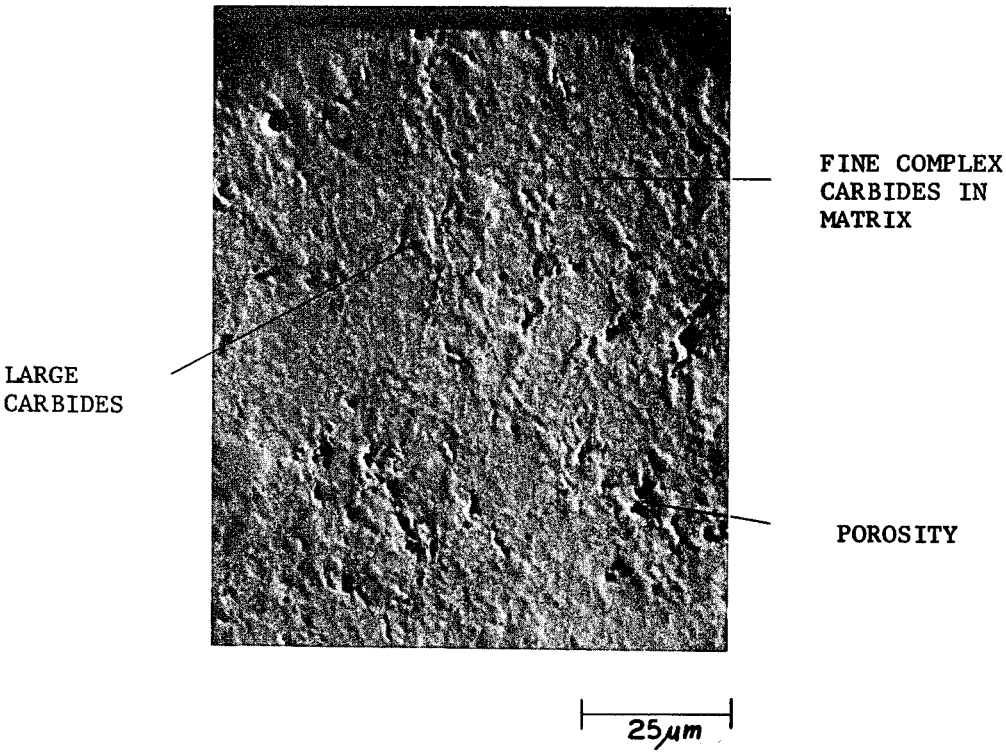
FIG. 4 is similar to FIG. 3, but shows the coating after heat treatment.

Examination of the coating after heat treatment showed the composition to be unchanged, but as seen in FIG. 4, the morphology was significantly different. Particles which may be fine Co-Cr carbides of the order of 1 micron in diameter are apparent in the matrix; because of their fineness, the composition or exact structure was not determinable. However, we characterize these as transition metal carbides inasmuch as only transition metals are present and capable of forming substantial carbides in our coatings (excepting the improbably or insubstantial combination with Al and Y). We would characterize the fine carbides in the unheat treated coating similarly. The previously observed $Cr_3C_2$ regions are seen to be substantially altered in appearance and less clearly defined and they are made substantially smaller—10 microns or less. These results are presumed to be due to diffusion and alloying. X-ray fluorescence of the coating as deposited and after heat treatment indicates that the carbon is dispersed throughout the coating, rather than all concentrated in the defined chromium carbide particles.

The amount of carbon and chromium added to a basic MCrAlY type alloys to produce new wear resisting alloys can be varied to suit the particular service environment to be encountered. For simplicity we state the chromium and carbon added to the basic MCrAlY in terms of the amount of $Cr_3C_2$ which the additions are representative of, even though as explained above, the elements are not all chemically combined as $Cr_3C_2$ in the coating. We find usable coatings to be those having from 5 to 85 weight percent $Cr_3C_2$. This range, when combined with the MCrAlY composition used in the preferred embodiment, results in a coating with the total weight of chromium varying from about 26 to 78%, and the carbon from about 0.65 to 11%. For low temperatures, e.g., below 750° C. (1400° F.), or severe wear applications, the chromium and carbon contents would be in the high portion of the range, as the carbide phases provide wear resistance. The upper limit is determined by the need for sufficient matrix to bind the carbides together and to the substrate. Beyond the upper limit the coating will degenerate due to the physical loss of carbides. At higher temperatures, in the 950° C. (1700° F.) range, conditions of less severe wear, or those requiring greater ductility, the lowest portion of the compositional range is suitable. The lower limit is determined by the need to provide improved wear resistance over conventional MCrAlY alloys. Sufficient carbon must be present to cause the presence of detectable carbides which impart wear resistance. Yttrium is included in MCrAlY coatings to enhance the oxidation-corrosion performance at the highest use temperatures, namely, above 950° C. (1700° F.). The function of yttrium in MCrAlY alloys has been well set forth in the prior art and the yttrium content of our inventions are accordingly determined by the same criteria. Since yttrium significantly increases high temperature properties, we believe at least some yttrium, should be present, 0.01% or more. For applications at lower temperatures it is possible to omit the yttrium without suffering adverse performance effect in carbon bearing MCrAlY coatings of the present invention.

The hardness of a coating is measured by several tests with a diamond penetrant hardness (DPH) tester using 300 gm loading, producing an impression width of 0.025 mm (0.001 inches) or larger, thereby giving a nominal hardness value for the matrix. The average hardness of the invention coating can be tailored from about 600 DPH to over 1000 DPH by variation of the carbon-chromium content. The hardness of the matrix provided by the invention is especially desirable for wear resistance. Undercutting of the even harder chromium carbide regions is thus avoided. The measured apparent hardness of the matrix is attributable to the very fine carbides dispersed therein, provided in the invention. The most suitable thicknesses for the invention coating are determined by the particular application and the dimension specified is normally that for a coating which is in its finished condition after machining. The preferred coating thickness can range from 0.013–0.09 cm (0.005–0.035 inch) and typically is in the 0.020–0.038 cm (0.008–0.015 inch) range, though of course for special applications other than Z-notches thinner coatings of 0.0025 cm (0.001 inch) or less may be usable.

For optimum oxidation, wear resistance, and adhesion of the coating to the substrate, the density of the coating should be high, for example, at least 95% of theoretical. The coating shown has a density of 98%.

The high hardness in combination with the outstanding oxidation and corrosion resistance of the CoCrAlY alloy provides a versatile invention coating having a unique structure and combination of properties usable under a wide variety of harmful service conditions. Such properties include a much better combination of adhesion, oxidation, corrosion and wear resistance at elevated temperatures than the prior art hardfacing alloys and composite or cermet coatings such as those having chromium carbide particles dispersed in a nickel-chromium or like alloy binder. In addition, the coating of the invention can be economically deposited on substrates by the advanced plasma spray technique described above as well as others.

The improved wear resistant coating of novel morphology can be expected to result from the addition of chromium and carbon to the ranges of MCrAlY type coatings disclosed in the prior art. The ranges have been previously described in various U.S. patents cited in the background section of this disclosure and the compositions in those patents are hereby incorporated by reference. (It is also in our contemplation that such improvements or refinements in MCrAlY coating composition as are in the future revealed will be usable within our invention.) When the above-referenced compositions, particularly those in Evans, U.S. Pat. No. 3,676,085, are included with from 5 to 85 percent chromium carbide ($Cr_3C_2$), the compositional ranges stated in the summary of the invention result. While the chromium and carbon are advantageously added in the form of particulate $Cr_3C_2$, where chromium and carbon are added in the ratio of 87% chromium and 13% carbon, they might be added in the form of other compounds such as complex carbides, sub-carbides, or carbon rich alloys since it is not a requirement that the carbon containing particles retain entirely intact their identify as particulate $Cr_3C_2$ in the coating to carry out the invention herein. Also, the coatings of the invention might be prepared by fabricating a master alloy of the desired composition, converting same to a powder, and plasma spraying the powder. Powders ranging in average particle size from 5 to 40 micron can be used, depending on the spraying equipment. Still other ways of achieving the desired coating composition on a superalloy article can be utilized by those skilled in the art of coating.

It may be noted here that compared to other coatings our coating exhibits unusual effects. First, there is the interaction of the matrix MCrAlY with the particulate chromium carbide to form the complex as-deposited structures. With the less complex alloys of the past such an effect was neither observed nor thought desirable. Second, the composition of our coating alloy differs substantially from that of Wolfa et al. in U.S. Pat. No. 4,124,137. We use the transition metal chromium instead of the refractory metal tantalum; tantalum is a strengthener whereas chromium is not. Conversely chromium enhances corrosion resistance whereas tantalum does not. Further in our coating chromium carbides are present whereas in the coating of Wolfa et al. tantalum carbides are present, and these carbides have differing properties.

To further illustrate the invention described herein, the following examples are given.

EXAMPLE 1

A mixture of two minus 44 micron particle size powders, one, a nichrome alloy comprised of 80% nickel and 20% chromium by weight, and the other a chromium carbide ($Cr_3C_2$), where the nichrome was 12 percent of the mixture, was applied with the plasma spray process to a nickel superalloy substrate. The deposited coating was measured to consist of 25% nichrome and 75% $Cr_3C_2$. Examination of the coating by x-ray diffraction showed that the constituent nichrome and $Cr_3C_2$ were present in the deposited coating. The $Cr_3C_2$ particles were essentially present in the particle size of the original mixture. Since it is well known to those in the art that nichrome has less favorable oxidation and corrosion properties in a gas turbine environment than MCrAlY coatings and since the chromium carbide particles are present in a conventional cermet manner, the matrix can be expected to have the limited properties of nichrom and the particles can be expected to be susceptible to pullout. The coating was measured to have a hardness of 400–700 DPH. Examination of a coating after heat treatment at 1975° F. for four hours did not show substantial change in the morphology of the coating from that of the as-deposited condition. However, when tested on a part, the heat treated coating was inferior to the unheat treated coating, exhibiting loss of adhesion from the substrate, spalling, and general degradation. This served to show the advantage of the invention compared to a material of the prior art, insofar as the result produced by heat treatment.

EXAMPLE 2

A mixture of minus 44 micron particle size powders, one a MCrAlY alloy comprised of 63% cobalt, 23% chromium, 13% aluminum, and 0.65% yttrium by weight, and the other a chromium carbide ($Cr_3C_2$) powder, where the MCrAlY was 50% of the mixture, was applied to a IN-718 nickel alloy substrate using an advanced plasma spray process. The coating was heat treated for four hours at 1975° F. The composition of the coating was found to be nominally 51% Co, 36% Cr, 10% Al, 2.6% C and 0.52% Y. The density was measured at 98% of maximum possible by metallographic pore counting and calculation. Examination of the coating by scanning electron microscope and electron microprobe showed complex unidentifiable carbides with diffused boundaries, indicating an interaction of the MCrAlY matrix with the carbides, which would not be expected in prior art metal matrix-carbide coatings. Smaller carbides of 1–2 micron diameter were dispersed through the matrix but could not be identified. The presence of carbides in the metal matrix of cermets is unexpected, as is the presence of carbides in a MCrAly coating. The hardness was measured to be about 600–700 DPH.

EXAMPLE 3

Eleven blades for the third stage of a high performance gas turbine were coated at the Z-notch location of the tip shroud with an 0.008 to 0.010 inch thick layer of the coating described in Example 2. The parts were installed in an engine where they were exposed to temperatures at nominally 1700° F. After more than 500 hours of engine operation the coatings showed no indication of degradation or failure.

EXAMPLE 4

A coating have the composition 64% chromium, 22.8% cobalt, 5.2% aluminum, 7.8% carbon, and 0.2% yttrium was applied to turbine blades and tested similarly to that described in Example 3. Favorable performance was also observed.

EXAMPLE 5

A coating having the composition 56.8% cobalt, 29.6% chromium, 11.7% aluminum, 1.3% carbon, and 0.6% yttrium was applied to turbine blades and tested similarly to that described in Example 3. Favorable performance was also observed.

It will be appreciated that the invention is not limited to the specific details shown in the examples and illustrations and that various modifications may be made within the ordinary skill in the art without departing from the spirit and scope of the invention.

We claim:

1. A superalloy article having a wear resisting and oxidation corrosion protective coating consisting essentially of a carbon rich MCrAlY matrix having fine transition metal carbides of the order of 1–2 microns size and coarser chromium carbides of the order of 12 microns size, produced by plasma spraying MCrAlY and $Cr_3C_2$ powders having particle sizes less than 44 microns, the coating having a carbon content of at least 0.6 weight percent wherein M is one or more of nickel, cobalt and iron.

2. The article of claim 1 wherein the coating consists essentially of, by weight percent 18–80 chromium, 1.2–29 aluminum, up to 4.8 yttrium, 0.6–11 carbon, balance selected from the group consisting of nickel, cobalt and iron or mixtures thereof.

3. The article of claim 2 wherein the elemental weight percents are 23–68 chromium, 4–22 aluminum, up to 4.4 yttrium, 1.5–7.8 carbon, balance selected from the group consisting of nickel, cobalt and iron, or mixtures thereof.

4. The article of claim 3 wherein the elemental weight percents are 36 chromium, 10 aluminum, 2.6 carbon, 0.5 yttrium, balance selected from the group consisting of nickel, cobalt, iron, or mixtures thereof.

5. The article of claim 1 wherein the matrix has a DPH hardness value greater than about 725.

* * * * *